US007189977B2

(12) United States Patent
Yamaguchi et al.

(10) Patent No.: US 7,189,977 B2
(45) Date of Patent: Mar. 13, 2007

(54) ELECTROSPRAY MASS SPECTROMETER AND ION SOURCE

(75) Inventors: Kentaro Yamaguchi, Chiba (JP); Tatsuji Kobayashi, Tokyo (JP)

(73) Assignee: JEOL Ltd., Tokyo (JP)

( * ) Notice: Subject to any disclaimer, the term of this patent is extended or adjusted under 35 U.S.C. 154(b) by 556 days.

(21) Appl. No.: 10/643,751

(22) Filed: Aug. 19, 2003

(65) Prior Publication Data

US 2006/0169887 A1 Aug. 3, 2006

(30) Foreign Application Priority Data

Aug. 19, 2002 (JP) ..... 2002-237793

(51) Int. Cl.
*H01J 49/00* (2006.01)

(52) U.S. Cl. ..... 250/425; 250/288

(58) Field of Classification Search ..... 250/425
See application file for complete search history.

(56) References Cited

U.S. PATENT DOCUMENTS 6,977,369 B2 * 12/2005 Yamaguchi et al. ..... 250/281

FOREIGN PATENT DOCUMENTS

| | | | |
|---|---|---|---|
| EP | 1174903 A | * | 1/2002 |
| JP | 2000-285847 | | 10/2000 |
| JP | 2002-015697 | | 1/2002 |

* cited by examiner

*Primary Examiner*—David A. Vanore
(74) *Attorney, Agent, or Firm*—The Webb Law Firm

(57) ABSTRACT

An inexpensive electrospray mass spectrometer capable of performing measurements consecutively from the ESI mode to the cold-spray ionization mode and vice versa. The electrospray mass spectrometer has an electrospray ion source, a nebulization nozzle, and a sampling orifice. The axes of the nozzle and orifice intersect each other. The instrument has a movable cold-spray desolvation chamber. In the electrospray ionization mode, the desolvation chamber is placed off the axis of the nebulization nozzle. In the cold-spray ionization mode, the desolvation chamber is set on the axis of the nebulization nozzle.

19 Claims, 3 Drawing Sheets

ELECTROSPRAY MASS SPECTROMETER AND ION SOURCE

BACKGROUND OF THE INVENTION

1. Field of the Invention

The present invention relates to an electrospray mass spectrometer and an ion source therefor.

2. Description of Related Art

An electrospray mass spectrometer using a soft ionization method has been proposed. In particular, a sample in solution is pumped from a liquid chromatograph (LC) or held in a solution reservoir. The sample is sent to a metallic capillary and drawn into it by pressure applied by an LC pump or by capillarity. A high voltage of several kilovolts is applied between the capillary and a counter electrode of the mass spectrometer to produce an electric field between them. The sample in solution in the capillary is electrostatically sprayed as charged droplets by the action of the electric field. The droplets are dried or cooled and guided into the mass spectrometer where they are analyzed.

This electrospray mass spectrometer provides a very soft ionization method in that neither application of heat nor bombardment of high-energy particles is used in ionizing sample molecules. Therefore, polar biopolymers, such as peptides, proteins, and nucleic acids, can be easily ionized as multiply charged ions almost non-destructively. Furthermore, they are multiply charged ions and so those which have molecular weights of more than 10,000 can be measured with a relatively small mass spectrometer. In this way, this instrument has excellent features.

Analytical methods of electrospray mass spectrometry include an analytical method using an ordinary ESI (electrospray ionization) ion source (for example, Japanese Patent Laid-Open No. 2002-15697) and an analytical method using a cold-spray ion source (for example, Japanese Patent Laid-Open No. 2000-285847). In the former method, charged liquid droplets are electrostatically sprayed. Solvent molecules form clusters around sample molecules in this spray of droplets. The solvent molecules are vaporized by heating. In the latter method, liquid droplets are formed by electrostatic nebulization or by nebulization without application of a voltage. The droplets are cooled to minimize removal of the solvent. Molecular ions with solvent molecules attached are produced. The solvent droplets are removed in a low-temperature desolvation chamber. These two methods have used with their respective dedicated ion sources. Therefore, measurements cannot be performed consecutively moving from the ESI mode to the cold-spray ionization mode and vice versa. Hence, two ion sources must be used. This increases the cost of the equipment. In addition, the analysis is complicated.

SUMMARY OF THE INVENTION

It is an object of the present invention to provide an inexpensive mass spectrometer instrument capable of performing measurements consecutively moving from the ESI mode to the cold-spray ionization mode and vice versa.

This object is achieved by a mass spectrometer fitted with an electrospray ion source having a nebulization nozzle and a sampling orifice. The axis of the nozzle and the axis of the orifice intersect each other. This spectrometer is further fitted with a movable cold-spray desolvation chamber. This movable desolvation chamber can be moved off the axis of the nebulization nozzle in the electrospray ionization mode and can be set on the axis of the nebulization nozzle in the cold-spray ionization mode.

In one feature of the present invention, the nebulization nozzle has a capillary for guiding a sample solution supplied from a sample inlet port and a guide pipe coaxially surrounding the outer surface of the capillary. The guide pipe guides a nebulizing gas introduced from a gas inlet port.

In another feature of the present invention, the temperature of the nebulizing gas is set to room temperature in the electrospray ionization mode and from room temperature to about −50° C. in the cold-spray ionization mode.

In a further feature of the present invention, the nebulization nozzle is inserted substantially coaxially in the cylindrical desolvation chamber and opens into this chamber. A heater for heating is buried in the walls of this chamber. This cylindrical desolvation chamber has a gas inlet port for introducing a heating-and-drying gas.

In still another feature of the present invention, the potential difference between the nebulization nozzle and the sampling orifice is 1 to 3 kV, and the potential difference between the walls of the cylindrical desolvation chamber and the sampling orifice is from zero to hundreds of volts.

In yet another feature of the present invention, where ions to be observed are positive ions, the potential at the sampling orifice is set lower. Conversely, where ions to be observed are negative ions, the potential at the sampling orifice is set higher.

In an additional feature of the present invention, the flow rate of the sample solution is 1 to 1,000 microliters/minute when a mixture of droplets of the sample in nebulizing gas is electrostatically sprayed from the nebulization nozzle.

In another feature of the prevent invention, a heating-and-drying gas is introduced from the gas inlet port in the electrospray ionization mode. This heating-and-drying gas and heating performed by a heater buried in the walls of the desolvation chamber cooperate to dry and desolvate the liquid droplets.

In another feature of the present invention, the heating temperature of the cylindrical desolvation chamber achieved by the heater is approximately +100 to 300° C.

In another feature of the present invention, the heating-and-drying gas has a temperature of approximately +100 to 300° C.

In another feature of the present invention, the supply of the heating-and-drying gas into the cylindrical desolvation chamber from the gas inlet port is discontinued in the cold-spray ionization mode. Also, the electric power supplied to the heater buried in the inner wall of the desolvation chamber is cut off. Multiply charged molecular ions with solvent molecules attached are produced.

In another feature of the present invention, a cooled gas is supplied from the gas inlet port into the cylindrical desolvation chamber in the cold-spray ionization mode.

In another feature of the present invention, the temperature of the cylindrical desolvation chamber is room temperature or below in the cold-spray ionization mode.

In another feature of the present invention, the temperature of the cylindrical desolvation chamber is from room temperature to about 0° C. in the cold-spray ionization mode.

In another feature of the present invention, a movable desolvation chamber has a direction-changing channel. Liquid droplets are introduced from the opening on the side of the nebulization nozzle and passed through the channel to the exit opposite to the sampling orifice. Then, the sample ions are discharged.

In another feature of the present invention, the second desolvation chamber is supported by a thin support rod for heat insulation.

In another feature of the present invention, the movable desolvation chamber is fitted with temperature control means, such as a microheater, Peltier element, and sensor.

In another feature of the present invention, the potential difference between the movable desolvation chamber and the sampling orifice is from zero to hundreds of volts.

In another feature of the present invention, where ions to be observed are positive ions, the potential at the sampling orifice is set lower. Conversely, where ions to be observed are negative ions, the potential at the sampling orifice is set higher.

In another feature of the present invention, the temperature of the sampling orifice is set to approximately +80° C. in the electrospray ionization mode and to approximately room temperature in the cold-spray ionization mode.

In another feature of the present invention, the amount of sample ions produced in the cold-spray ionization mode is from one-hundredth to one-thousandths (1/100 to 1/1,000) of the amount of sample ions produced in the electrospray ionization mode.

Other objects and features of the invention will appear in the course of the description thereof, which follows.

DESCRIPTION OF THE PREFERRED EMBODIMENTS

Figure 1:
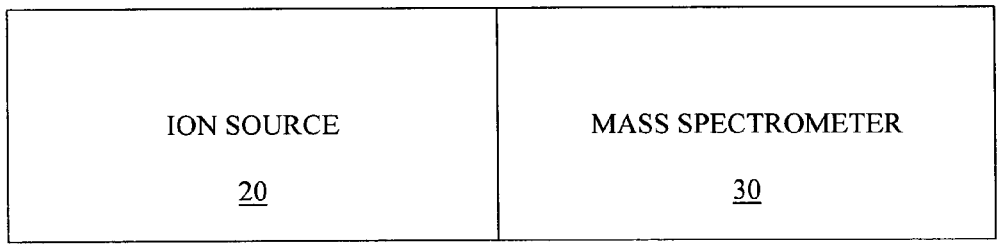
FIG. 1 is a schematic drawing illustrating the relationship between an ion source and associated mass spectrometer.

FIG. 1 illustrates the relationship between an ion source 20 and a mass spectrometer 30. The ion source 20 supplies the ions which the spectrometer 30 separates by mass-to-charge ratio as is well understood in the art. Often, the combination of the ion source 20 and mass spectrometer 30 is simply referred to as a spectrometer.

Figure 2A:
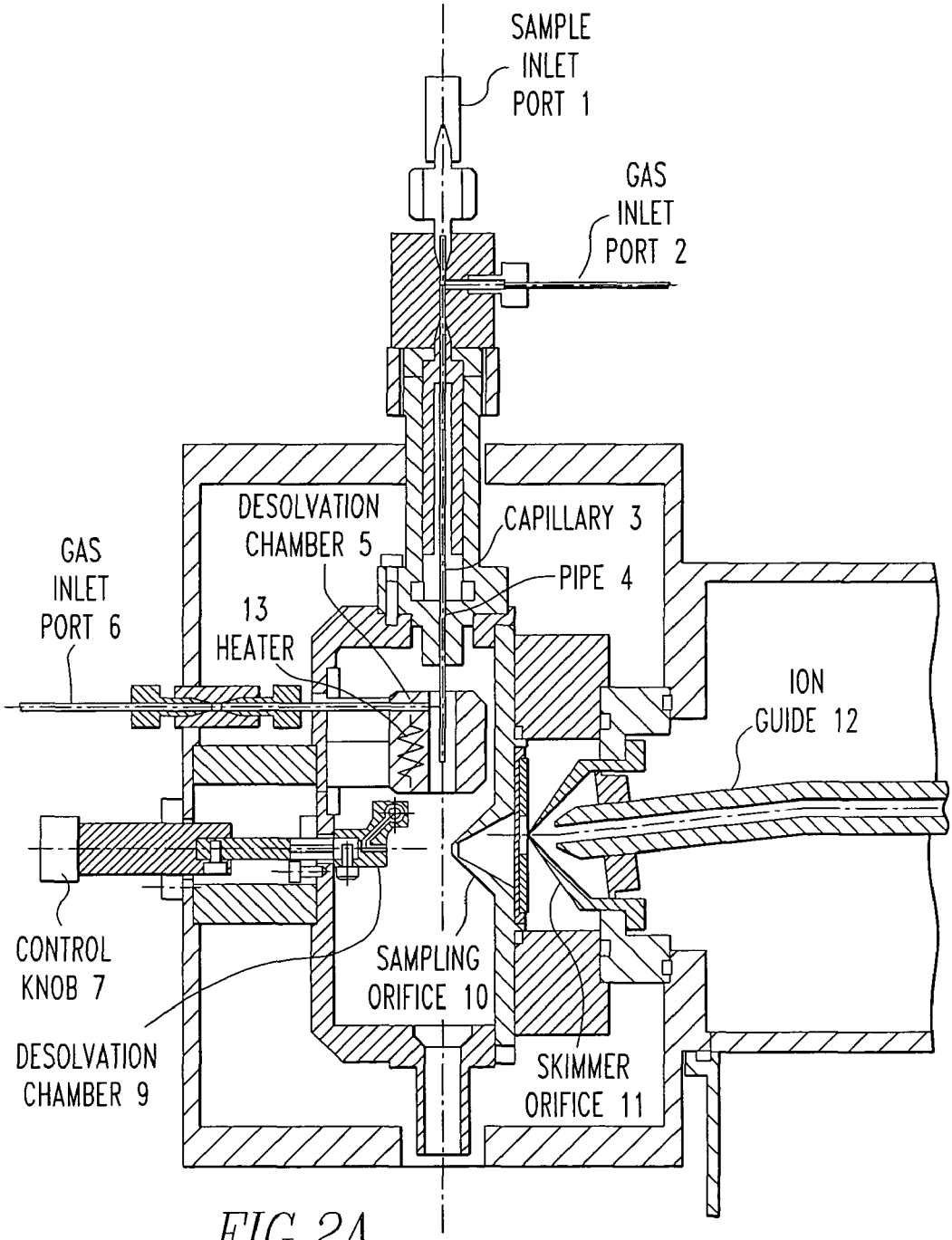
FIG. 2A is a diagram of an electrospray ion source for a mass spectrometer according to the present invention in which the spectrometer is operated in the ESI mode.
Figure 2B:
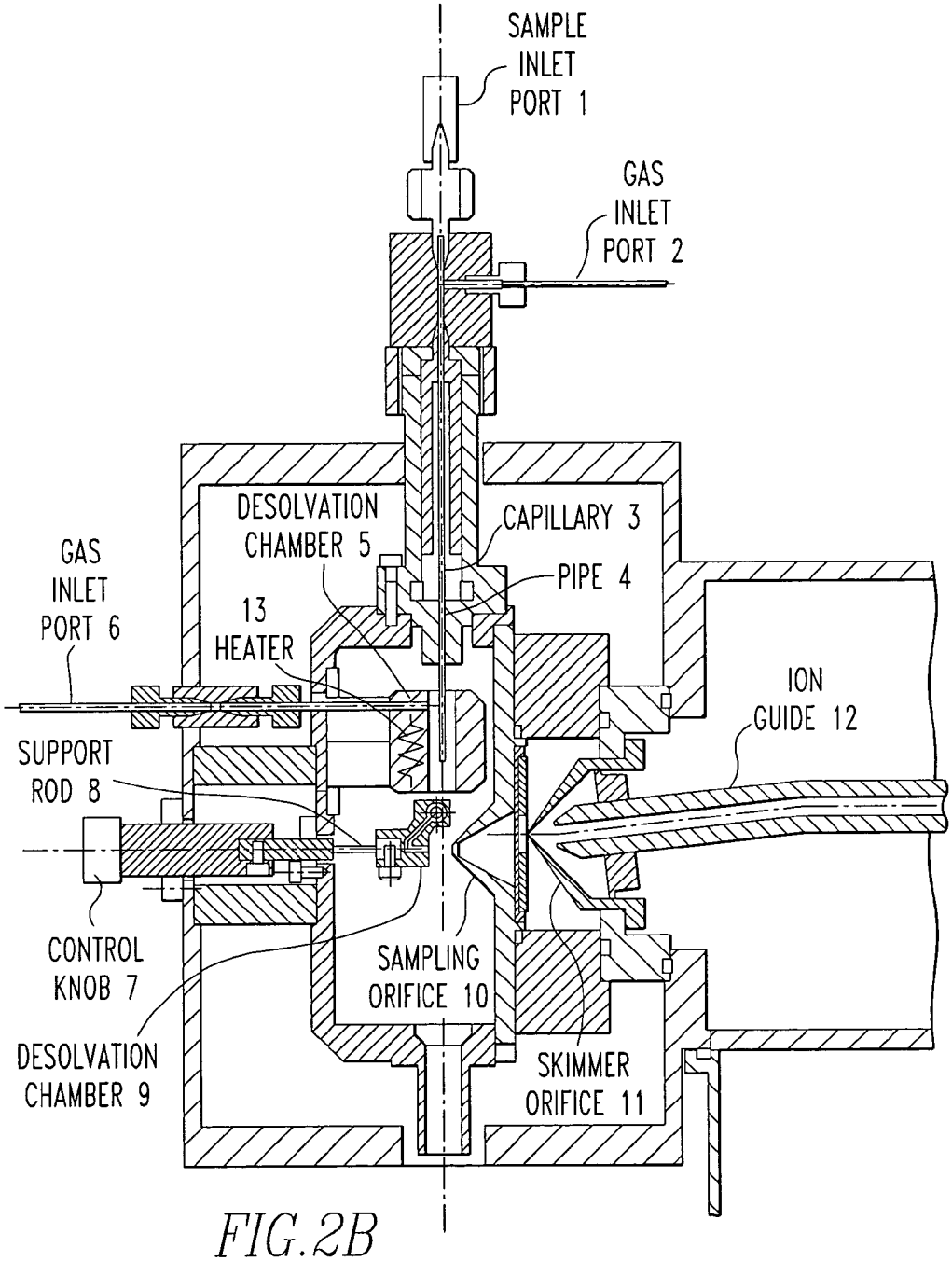
FIG. 2B is a diagram of the ion source of FIG. 2A in which the spectrometer is operated in the cold-spray ionization mode.

An electrospray mass spectrometer according to one embodiment of the present invention is shown in FIGS. 2A and 2B. FIG. 2A shows the manner in which the instrument is operated in the ESI mode. FIG. 2B shows the manner in which the instrument is operated in the cold-spray ionization mode. The novel electrospray mass spectrometer is a single instrument capable of both analysis in the ESI mode and analysis in the cold-spray ionization mode.

FIG. 2A illustrates the usage in the ESI mode. A sample inlet port 1 consists of a pipe fitted with a joint. A solution sample is supplied to the sample inlet port 1 from a syringe pump (not shown) and is guided into a capillary 3. A pipe 4 coaxially surrounds the outer surface of the capillary 3. A room-temperature nebulizing gas consisting of an inert gas, such as nitrogen gas, is admitted from the gas inlet port 2 into the pipe 4. The front end of the pipe 4 forms a nebulization nozzle. The front end of the nozzle is inserted in a cylindrical first desolvation chamber 5 substantially coaxially and opens into this chamber. A heater 13 (shown schematically) for heating is buried in the inner wall of the desolvation chamber 5. A power supply (not shown) applies a potential difference of about 1 to 3 kV between the inner wall of the cylindrical first desolvation chamber 5 and the nebulization nozzle. Because of this potential difference, a mixture of droplets of the sample and the nebulizing gas is electrostatically sprayed from the front end of the nebulization nozzle. At this time, the flow rate of the solution sample is about 1 to 1,000 microliters per minute. A heating-and-drying gas heated to about +100 to 300° C. is admitted into the first desolvation chamber 5 from a gas inlet port 6. The inner wall of the first desolvation chamber 5 is heated to about +100 to 300° C. by the heater 13. Thus, radiative heat is produced from this inner wall. The heating-and-drying gas and the radiative heat cooperate to vaporize the solvent molecules in the sample droplets. Consequently, the liquid droplets are dried and desolvated.

A support rod 8 extends from a control knob 7. A second movable desolvation chamber 9 is mounted at the front end of this support rod 8. This movable desolvation chamber 9 is used in the cold-spray ionization mode. During the ESI mode, the second desolvation chamber 9 is retracted and placed off the axis of the nebulization nozzle and so desolvated sample molecular ions fly toward a sampling orifice 10 without being guided by the second desolvation chamber 9. The orifice 10 is heated to about +80° C.

The space between the sampling orifice 10 and a skimmer orifice 11 is evacuated to about 200 Pa by a rotary vacuum pump (not shown). The inside of the skimmer orifice 11 is evacuated to a higher degree of vacuum of about 1 Pa. Therefore, the desolvated sample molecular ions are sucked from the sampling orifice 10 into the skimmer orifice 11 and passed into an analyzer chamber, which is maintained at a high vacuum of about $10^{-3}$ Pa, through an ion guide 12.

The potential difference between the sampling orifice 10 and the nebulization nozzle is set to about 1 to 3 kV. The potential difference between the sampling orifice 10 and the first desolvation chamber 5 is set from 0 to hundreds of volts. Where ions to be observed are positive ions, the potential at the sampling orifice 10 is set lower. Conversely, where ions to be observed are negative ions, the potential at the sampling orifice 10 is set higher.

FIG. 2B shows the usage in the cold-spray ionization mode. In this mode, the operator pushes in the control knob 7 to move and set the second desolvation chamber 9 into the position on the axis of nebulization nozzle. Liquid droplets sprayed from the front end of the nebulization nozzle are guided into the second desolvation chamber 9.

The sample solution is introduced into the capillary 3 through the sample inlet port 1. The nitrogen gas cooled from room temperature to about −50° C., more preferably, from room temperature to −10° C., is introduced from the gas inlet port 2 into the pipe 4 that coaxially surrounds the outer surface of the capillary 3. The capillary 3 and pipe 4 together form a nebulization nozzle. The front end of the nebulization nozzle is inserted in the cylindrical first desolvation chamber 5 substantially coaxially and opens into this chamber.

Because of the potential difference of about 1 to 3 kV applied between the inner wall of the cylindrical first desolvation chamber 5 and the nebulization nozzle by the power supply (not shown), a mixture of droplets of the sample solution and cooled nitrogen gas are electrostatically sprayed from the front end of the nozzle or are sprayed while no voltage is applied. Under this state, the flow rate of the solution sample is set to 1 to 1,000 microliters per minute. At this time, the introduction of the heating-and-drying gas into the gas inlet port 6 is normally discontinued to prevent the liquid droplets from being warmed. Instead of the heating-and-drying gas, a low-temperature, drying gas that is controlled to cool may be supplied.

In this mode, the heater 13 buried in the inner wall of the first desolvation chamber 5 is deenergized and so no heating is done. Therefore, room temperature or below is maintained. The desolvation function is not performed. Removal of the solvent from the sprayed liquid droplets is reduced to a minimum. Only the function of producing multiply charged molecular ions with solvent molecules attached is implemented.

Then, the low-temperature liquid droplets are passed into the second desolvation chamber 9 and collided against the chamber wall together with the low-temperature nebulizing gas, the second desolvation chamber 9 being cooled from room temperature to about 0° C. by the cooling nebulizing gas itself. During the process where the droplets pass through the direction-changing channel, they are pulverized minutely. The solvent is partly vaporized off without heating the liquid droplets. The amount of the resulting sample molecular ions is 1/100 to 1/1,000 compared with the case of the ordinary ESI process. Hence, the analytical sensitivity for the sample concentration is not as good. However, molecular structures of the sample molecular ions that would be easily destroyed by the ordinary ESI process using heating are maintained due to the low temperature.

The second desolvation chamber 9 is so designed that the liquid droplets are admitted from the opening on the side of the nebulization nozzle. The droplets pass through the direction-changing channel. The sample molecular ions are discharged from the exit opposite to the sampling orifice 10. Therefore, it is essential to finely adjust the position of the opening of the second desolvation chamber 9 relative to the nebulization nozzle. Thus, an XY manipulator is provided to permit an optimum position to be searched for by finely adjusting the surface against which the spray is collided.

This second desolvation chamber 9 is supported by a thin support rod 8 to maintain the low temperature. This prevents external heat from entering from the control knob 7 through the support rod 8. Consequently, this support rod 8 acts as a heat insulation material.

Sample ions emerging from the second desolvation chamber 9 are drawn into the sampling orifice 10, which is pumped down to about 200 Pa by a rotary pump (not shown), and then into the skimmer orifice 11 that is evacuated to about 1 Pa. Subsequently, the ions are passed via the ion guide 12 into the analytical chamber that is maintained at a high vacuum of about $10^{-3}$ Pa.

In the cold-spray ionization mode, the temperature of the sampling orifice 10 is kept close to room temperature by deenergizing the heater.

In the cold-spray ionization mode, the potential difference between the sampling orifice 10 and the nebulization nozzle is set to about 1 to 3 kV and the potential difference between the orifice 10 and the first desolvation chamber 5 is set from zero to hundreds of volts, in the same way as in the ESI mode. The potential difference set up between the sampling orifice 10 and the second desolvation chamber 9 only in the cold-spray ionization mode is set from zero to hundreds of volts. Where ions to be observed are positive ions, the potential at the sampling orifice 10 is set lower. Conversely, where the ions to be observed are negative ions, the potential at the sampling orifice 10 is set higher.

The set temperatures of the various portions in the ESI and the cold-spray ionization modes are listed in Table I.

TABLE I

The set temperatures of the various portions

| | ESI Mode | Cold-Spray Ionization Mode |
|---|---|---|
| nebulizing Gas | room temperature | room temperature~−50° C. |
| first desolvation chamber | 100~300° C. | ~room temperature |
| heated dry gas | 100~300° C. | disuse (or use cooled dry gas) |
| second desolvation chamber | disuse | room temperature~0° C. |
| sampling orifice | 80° C. | ~room temperature |

The set potential differences between various portions are listed in Table II.

TABLE II

The set potential differences

| | |
|---|---|
| between nebulization nozzle and sampling orifice | 1 kV~3 kV |
| between first desolvation chamber and sampling orifice | zero~several hundred V |
| between second desolvation chamber and sampling orifice | zero~several hundred V |

It is to be understood that the present invention is not limited to the above embodiment. Rather, various changes and modifications are possible. For example, the control knob for the second desolvation chamber 9 used in the cold-spray ionization mode is not limited to the type in which it is operated from the side opposite to the sampling orifice 10. The control knob 7 may be operated from any side or direction. In summary, the control knob 7 may be mounted at any desired position as long as this desolvation chamber can be placed off the axis of the nebulization nozzle in the ESI mode and set on the axis of nebulization nozzle in the cold-spray ionization mode. That is, in the cold-spray ionization mode, sprayed liquid droplets can be accepted, and the desolvated molecules can be discharged toward the sampling orifice 10.

Furthermore, an adjustment may be made to optimize the positional relation between the nebulization nozzle and the second desolvation chamber 9, for example, by (1) moving and setting the second desolvation chamber 9 onto the axis of the nebulization nozzle and moving this nebulization nozzle, (2) moving both second desolvation chamber 9 and the nebulization nozzle, (3) visually checking the flow of the sprayed liquid droplets, or (4) monitoring the intensities of mass spectra obtained by the mass spectrometer from the viewing screen of the spectrometer.

The angle formed between the axis of the nebulization nozzle and the axis of the opening of the sampling orifice 10 is set to 90° in the embodiment of FIGS. 2A and 2B. This angle is not limited to 90°. For instance, the angle may be varied to any desired value within the range from 0° to 90°. In this case, it is only necessary that the liquid droplets sprayed from the nebulization nozzle be taken into the second desolvation chamber 9 and the desolvated molecules be discharged toward the sampling orifice 10.

Moreover, the second desolvation chamber 9 may have a built-in microheater, Peltier element, sensor, or other temperature control means to provide an accurate temperature control.

Further, the exit opening of the second desolvation chamber 9 is not always required to be coaxial with the opening of the sampling orifice 10.

As described so far, the present invention makes it possible to perform measurements consecutively from the ESI mode to the cold-spray ionization mode and vice versa by simply pushing or pulling the control knob. It is not necessary to prepare two ion sources. Consequently, the cost can be reduced. In addition, in the ESI mode, the desolvation chamber for the cold-spray ionization mode operation is retracted and so contamination due to adhesion of liquid droplets is low. Hence, it is easy to perform cleaning.

Having thus described our invention with the detail and particularity required by the Patent Laws, what is desired to be protected by Letters Patent is set forth in the following claims.

The invention claimed is:

1. An electrospray mass spectrometer fitted with an electrospray ion source, said ion source comprising a structure supporting a nebulization nozzle, a sampling orifice, a heated desolvation chamber and a control knob supporting a support rod, said nebulizing nozzle having an axis and said sampling orifice having an axis, the axis of the nebulization nozzle intersecting the axis of the sampling orifice, said electrospray ion source further comprising a movable desolvation chamber having a direction-changing channel and being supported from said support rod such that the movable desolvation chamber can be moved off the axis of the nebulization nozzle in an electrospray ionization mode and set on the axis of the nebulization nozzle in a cold-spray ionization mode wherein liquid droplets are introduced from an opening from the nebulization nozzle and pass through the direction-changing channel such that sample ions are discharged from an exit opposite to the sampling orifice.

2. The electrospray mass spectrometer of claim 1, wherein said nebulization nozzle consists of a capillary for guiding a sample solution supplied from a sample inlet port and a pipe for guiding a nebulizing gas introduced from a gas inlet port, said pipe coaxially surrounding the outer surface of said capillary.

3. The electrospray mass spectrometer of claim 2, wherein the temperature of said nebulizing gas is adjustable between room temperature and approximately −50° C. For use of the electrospray mass spectrometer in the cold-spray ionization mode.

4. The electrospray mass spectrometer of claim 1, wherein said heated desolvation chamber is cylindrical and said nebulization nozzle is substantially coaxially inserted in a heated cylindrical desolvation chamber, the nozzle opening into the cylindrical desolvation chamber, and wherein said cylindrical desolvation chamber has a gas inlet port for introducing a heating-and-drying gas.

5. The electrospray mass spectrometer of claim 4, wherein a potential difference of 1–3 kV is imposed between said nebulization nozzle and the sampling orifice, and wherein a potential difference from zero to hundreds of volts is imposed between said cylindrical desolvation chamber and the sampling orifice.

6. The electrospray mass spectrometer of claim 4, wherein in the electrospray ionization mode, the heating-and-drying gas is introduced into said cylindrical desolvation chamber from the gas inlet port, and wherein the introduced heating-and-drying gas and heating performed by a heater buried in an inner wall of the desolvation chamber cooperate to dry and desolvate the liquid droplets.

7. The electrospray mass spectrometer of claim 6, wherein the heater for the cylindrical desolvation chamber is controllable between 100 and 300° C.

8. The electrospray mass spectrometer of claim 6, wherein the temperature of said heating-and-drying gas is controllable between 100 and 300° C.

9. The electrospray mass spectrometer of claim 4, wherein means for cutting off the supply of the heating-and-drying gas from the gas inlet port and means to deenergize the heater buried in the inner wall of the cylindrical desolvation chamber are provided to avoid heating of the liquid droplets passing therethrough in the cold-spray mode.

10. The electrospray mass spectrometer of claim 9, wherein means are provided for supplying a cooled gas into said cylindrical desolvation chamber from the gas inlet port.

11. The electrospray mass spectrometer of claim 9 or 10, wherein temperature of said movable desolvation chamber is setable to room temperature or below in the cold-spray ionization mode.

12. The electrospray mass spectrometer of claim 1, wherein when a mixture of droplets of a sample and a nebulizing gas are electrostatically sprayed from said nebulization nozzle and the flow rate of sample solution is setable to 1–1,000 microliters per minute.

13. The electrospray mass spectrometer of claim 1, further comprising means for setting the temperature of said desolvation chamber between room temperature and approximately 0° C. in the cold-spray ionization mode.

14. The electrospray mass spectrometer of claim 1, wherein said movable desolvation chamber is supported by a thin support rod for heat insulation.

15. The electrospray mass spectrometer of claim 1, wherein said movable desolvation chamber is fitted with temperature control means such as a microheater, Peltier element, or sensor.

16. The electrospray mass spectrometer of claim 1, wherein a potential difference of zero to hundreds of volts is developed between said movable desolvation chamber and said sampling orifice.

17. The electrospray mass spectrometer of claim 1, further comprising means for setting the sampling orifice to a temperature of approximately +80° C. in the electrospray ionization mode and to around room temperature in the cold-spray ionization mode.

18. The electrospray mass spectrometer of claim 1, wherein the ratio of the amount of ions relative to sample concentration produced in the cold-spray ionization mode is 1/100 to 1/1,000 of the amount of ions relative to sample concentration produced in the electrospray ionization mode.

19. The electrospray mass spectrometer of claim 1, wherein the direction-changing channel in the movable desolvation chamber is configured to pulverize the liquid droplets minutely to cause partial vaporization without heating the droplets.

* * * * *